United States Patent [19]

Payne et al.

[11] 4,332,692

[45] Jun. 1, 1982

[54] LAUNDERING WITH A NONIONIC DETERGENT SYSTEM AT A TEMPERATURE BETWEEN THE CLOUD POINT AND THE PHASE COALESCENCE TEMPERATURES

[75] Inventors: Nicholas S. Payne, Cincinnati, Ohio; Thomas D. Storm, Tucson, Ariz.; Theodore C. Stephens, Cincinnati, Ohio

[73] Assignee: The Procter & Gamble Company, Cincinnati, Ohio

[21] Appl. No.: 156,536

[22] Filed: Jun. 5, 1980

Related U.S. Application Data

[63] Continuation of Ser. No. 16,048, Feb. 28, 1979, abandoned.

[51] Int. Cl.[3] ..... C11D 3/075

[52] U.S. Cl. ..... 252/135; 252/174.21; 252/174.22

[58] Field of Search ..... 252/174.22, 174.21, 252/135

[56] References Cited

U.S. PATENT DOCUMENTS

| | | | |
|---|---|---|---|
| 2,594,453 | 4/1952 | Kosmin et al. | 252/140 |
| 2,674,619 | 4/1954 | Lundsted | 260/485 |
| 2,677,700 | 5/1954 | Jackson et al. | 260/488 |
| 2,746,929 | 5/1956 | Wells et al. | 252/135 |
| 2,746,930 | 5/1956 | Wells et al. | 252/135 |
| 2,828,345 | 3/1958 | Spiggs | 260/615 |
| 2,867,585 | 1/1959 | Vitale | 252/135 |
| 2,878,201 | 3/1959 | Feldman | 252/174.21 |
| 3,000,831 | 9/1961 | Tuvell | 252/138 |
| 3,022,335 | 2/1962 | Lundsted | 260/485 |
| 3,060,124 | 10/1962 | Ginn | 252/135 |
| 3,110,724 | 11/1963 | Woodbridge | 260/469 |
| 3,126,555 | 3/1964 | Curtin et al. | 8/149.1 |
| 3,203,955 | 8/1965 | Jackson et al. | 260/247.7 |
| 3,306,858 | 2/1967 | Oberle | 252/99 |
| 3,382,178 | 5/1968 | Lissant | 252/135 |
| 3,591,508 | 7/1971 | Huggins et al. | 252/137 |
| 3,758,410 | 9/1973 | Liu | 252/89 |
| 3,799,880 | 3/1974 | Kelly et al. | 252/110 |
| 3,816,351 | 6/1974 | Lancz | 252/527 |
| 3,853,779 | 12/1974 | Inamorato et al. | 252/110 |
| 3,925,224 | 12/1975 | Winston | 252/89 |
| 3,943,178 | 3/1976 | Stein et al. | 260/615 |
| 4,000,080 | 12/1976 | Bartolotia et al. | 252/99 |
| 4,083,793 | 4/1978 | Jakobi et al. | 252/99 |
| 4,140,650 | 2/1979 | Wilde | 252/135 |
| 4,248,729 | 3/1981 | Rubingh et al. | 252/174.22 |
| 4,248,911 | 2/1981 | Wixon | 427/214 |

FOREIGN PATENT DOCUMENTS

| | | |
|---|---|---|
| 652762 | 11/1962 | Canada . |
| 1083004 | 11/1977 | Canada . |
| 716641 | 10/1954 | United Kingdom . |
| 1462134 | 1/1977 | United Kingdom . |
| 1489694 | 10/1977 | United Kingdom . |
| 1495145 | 12/1977 | United Kingdom . |
| 1495146 | 12/1977 | United Kingdom . |
| 1518676 | 7/1978 | United Kingdom . |
| 2005715 | 4/1979 | United Kingdom . |
| 1579261 | 11/1980 | United Kingdom . |

OTHER PUBLICATIONS

Jefferson Chemical Co., SURFONIC® LR Series (1963), pp. 2, 3, 8–9.

Jefferson Chemical Co., SURFONIC® LF-16 & LF-17 (1967).

Plurafac® Nonionic, Wyandott Corp. (1972) Table 12, Formulation A.

Plurafac® A-16 & A-26, Wyandott Corp. (1965), pp. 1–6.

Tergitol® 25-L (1978), pp. 10–16.

*Primary Examiner*—Mayer Weinblatt

*Attorney, Agent, or Firm*—Leonard Williamson; Richard C. Witte; Ronald L. Hemingway

[57] ABSTRACT

An improved method for laundering fabrics to remove oily soil is disclosed, wherein fabrics are contacted with a washing liquor comprising an aqueous solution of a nonionic surfactant system and other ingredients. The washing temperature and ingredients of the washing liquor are selected so that washing occurs at a temperature which is substantially above the cloud point of the washing liquor and below the phase coalescence temperature of the washing liquor. Compositions useful in the practice of this invention are also disclosed, comprising a nonionic surfactant to which is added one or more strong electrolytes. Such compositions may be diluted with water to form a washing liquor which has cloud point and phase coalescence temperatures which are tailored for washing, within the scope of the present method, at a temperature preferred in the art. Conventional sequestering detergency builders and adjuvants may be added to the compositions as desired to optimize the cleaning result. The compositions may be formulated to provide a washing liquor pH of less than about 11 without diminishing the cleaning performance of the washing liquor.

12 Claims, 5 Drawing Figures

LAUNDERING WITH A NONIONIC DETERGENT SYSTEM AT A TEMPERATURE BETWEEN THE CLOUD POINT AND THE PHASE COALESCENCE TEMPERATURES

This is a continuation, of application Ser. No. 016,048, filed Feb. 28, 1979, now abandoned.

TECHNICAL FIELD

The area of technology pertaining to this invention is that of laundering fabrics, particularly in the context of commercial or industrial laundries which handle very heavy soil loads. The field of compositions useful for laundering fabrics to remove oily soil is also dealt with herein.

BACKGROUND ART

The inventors know of several references which disclose laundering processes conducted at a washing temperature roughly equal to the cloud point temperature of the washing liquor, but none of these references appears to teach washing substantially above the cloud point temperature, yet below the phase coalescence temperature. For example, U.S. Pat. No. 3,707,506, issued to Lozo on Dec. 26, 1972, suggests at Col. 1, lines 44–54, that there is some error in the prior art belief that maximum efficiency in removing dirt with a nonionic washing liquor is obtained at temperatures below the detergent cloud point. The Lozo reference does not provide any positive teaching, however, as to what washing temperature may be selected to improve washing results. An article by Cook entitled "Versatility of Nonionic Detergents" published in *Soap and Chemical Specialties,* May 1955, pages 47–49, indicates that a nonionic detergent works best if its surface active agent is not completely dissolved, but rather is partially in a colloidal state which promotes micelle formation. U.S. Pat. No. 3,925,224, issued to Winston on Dec. 9, 1975, similarly teaches that a cloudy solution of a surfactant is optimal for laundering fabrics. It is believed that the Cook and Winston references essentially describe washing at the cloud point temperature of the washing liquor rather than at a temperature substantially above the cloud point temperature.

Two references have been found which provide teachings contrary to the present development, indicating that it is undesirable to wash at or above the cloud point temperature. These references are: U.S. Pat. No. 3,890,238, issued to Boehmer on June 17, 1975; and Colwell et al., "Considerations in the Use of Nonionic Surface Active Agents," *American Dye Stuff Reporter,* Vol. 50, Sept. 4, 1961, 39 (cumulative page 679).

British Patent Specification No. 1,518,676, naming Mould et al. as inventors and published July 19, 1978, teaches washing substantially above the phase coalescence temperature of the washing liquor, but not within the temperature range between the cloud point and phase coalescence temperatures.

The prior art teaches that it is known to add a strong electrolyte to an aqueous solution containing a nonionic surfactant in order to lower the cloud point of the solution. For example, see Schick, *Nonionic Surfactants,* Marcel Dekker, Inc. (NY, 1966), Library of Congress Cat. Card No. 66-22492, especially pages 572–573.

Numerous prior art references can be found which generally indicate that a nonionic detergent may be combined with a builder, a strong electrolyte, or mixtures thereof to form washing compositions. However, no such disclosures are known which reveal compositions having the relatively narrow ranges of proportions of strong electrolytes and builders which are necessary to realize the present improvement at specific temperatures which are typical in the field of commercial laundering.

SUMMARY DISCLOSURE OF THE INVENTION

The invention is a process for laundering oily soil from fabrics by contacting the fabrics with an aqueous washing liquor comprising 1800 to 20,000 parts per million (ppm) of a nonionic surfactant system which has a critical micelle concentration (CMC) less than 50 ppm measured at 25° C., and which has a hydrophilic/lipophilic balance index (HLB) of 10–13, while maintaining the washing liquor at a temperature which is broadly defined by the following equation:

$$0.30(B-A)+A \leqq T < B$$

wherein T is the temperature of the washing liquor, B is the phase coalescence temperature of the washing liquor, and A is the cloud point temperature of the washing liquor.

The nonionic surfactant used to practice the invention is preferably selected from alkyl phenol ethoxylates, ethylene oxide/propylene oxide block copolymers, and aliphatic ethoxylated alcohols. The condensation products of fatty alcohols having 12 to 15 carbon atoms with an average of 5 to 8 ethoxylate moieties per molecule of surfactant are especially preferred, and most preferred is the condensate of a primary fatty alcohol having 14 to 15 carbon atoms with an average of about 7 ethoxylate moieties per molecule of surfactant.

A preferred temperature range for practice of the present invention is given by the expression:

$$0.50(B-A)+A \leqq T < B$$

and an especially preferred temperature for practice of the present invention is given by the expression:

$$0.70(B-A)+A \leqq T < B.$$

The following ingredients may be combined in the indicated proportions to produce compositions which may be diluted in water to produce washing compositions useful to practice the present invention:

(a) about 10% to about 78% of a nonionic surfactant;
(b) about 4% to about 45% of a strong electrolyte; and
(c) about 3% to about 45% of a sequestering builder.

Such compositions may be dissolved in water to form a solution which contains from about 1000 ppm to 40,000 ppm (0.10% to 4.0%) of the composition.

The following compositions contain preferred proportions of specific ingredients. They may be diluted in the proportions noted above to form washing liquors which may be used to practice the method disclosed herein:

(a) 20% to 51% of an alkali metal tripolyphosphate;
(b) 24% to 40% of an alkali metal carbonate; and
(c) 20% to 51% of the condensate of a fatty alcohol having 12 to 15 carbon atoms with an average of about 5 to about 8 ethoxylate moieties per molecule of surfactant; or (a) 20% to 40% of an alkali metal pyrophosphate;
(b) 25% to 40% of an alkali metal carbonate; and
(c) 20% to 55% of the condensate of a fatty alcohol having 12 to 15 carbon atoms with an average of about 5 to about 8 ethoxylate moieties per molecule of surfactant.

Finally, the following compositions are specifically formulated for optimal washing when a wash temperature of about 140° F. (60° Celsius) is selected:
(a) about 36% sodium tripolyphosphate;
(b) about 35% sodium carbonate; and
(c) about 29% of the condensate of a primary fatty alcohol having 14 to 15 carbon atoms with an average of about 7 ethylene oxide moieties per molecule of surfactant; or
(a) about 31% tetrasodium pyrophosphate;
(b) about 34.6% sodium carbonate; and
(c) about 34.4% of the condensate of a primary fatty alcohol having 14 to 15 carbon atoms with an average of about 7 ethylene oxide moieties per molecule of surfactant.

The washing liquors and compositions of the present invention provide optimal cleaning performance for a particular washing temperature, and also may be used for effective washing at a pH of less than 11, preferably from about 7 to about 11, with essentially undiminished cleaning performance. The present low pH compositions and washing liquors are thus gentler to fabrics and safer to store, ship and use than typical compositions used in industrial laundries, which provide a pH in the wash liquor greater than about 11.5.

DETAILED DESCRIPTION OF THE INVENTION

Definitions

Figure 1:
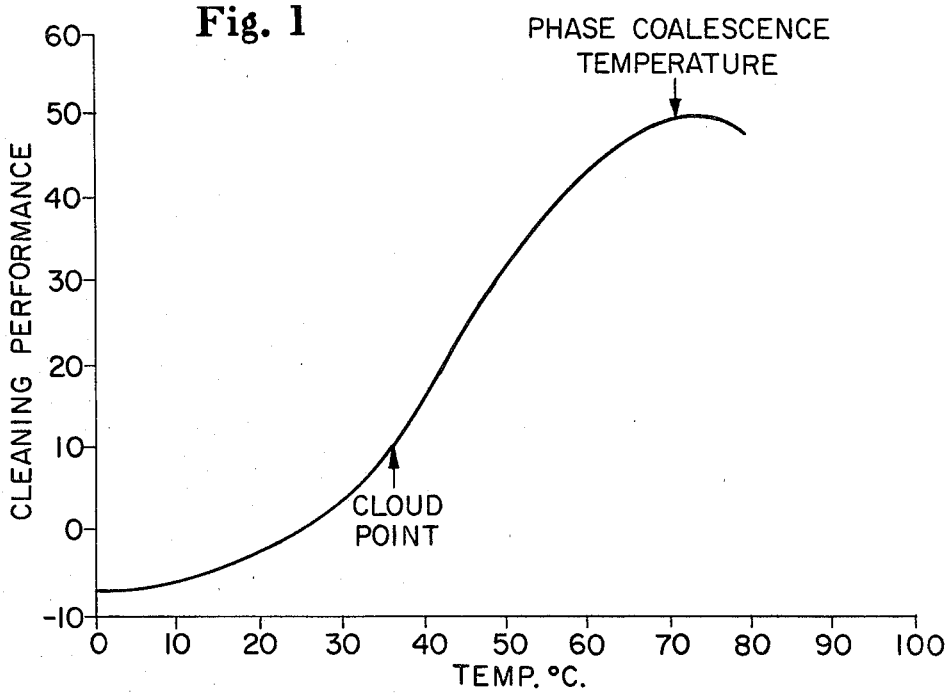
FIG. 1 is a graph showing the relation of the cleaning performance of a washing liquor of the present invention to washing temperature, for a surfactant system with a cloud point temperature of 36° C. and a phase coalescence temperature of 71° C.

In the course of describing this invention it will be useful to define the following terms:

By "nonionic surfactant" is meant a surfactant comprising a lipophilic moiety and a hydrophilic moiety, which does not ionize in aqueous solution.

By "hydrophilic/lipophilic balance index," or "HLB," is meant a numerical index for a given surfactant structure, indicating its balance of hydrophilic and lipophilic properties. A surfactant with a high HLB is more hydrophilic and less lipophilic in character than a surfactant with a low HLB.

By "critical micelle concentration," or "CMC," is meant the concentration of a surfactant in aqueous solution at which the concentration of monomeric surfactant molecules (as opposed to micelles) is maximized. At concentrations of a surfactant exceeding its CMC, monomer concentration remains essentially constant.

By "cloud point temperature" is meant the minimum temperature above 30° C. at which a sharp increase in light scatter is detected on a photo gonio diffusometer due to the formation of muclei of sufficient size to scatter light, i.e., the minimum temperature at which a sharp increase in cloudiness is observed in an aqueous surfactant solution as it is heated. The existence of a cloud point is one of the indicia of nonionic surfactants which are useful to practice the present invention.

By "phase coalescence temperature" is meant the minimum temperature at which a solution comprising a nonionic surfactant and water separates into two bulk phases, as distinguished from the cloud point temperature at which a single, colloidal bulk phase is observed. (The two bulk phases above the phase coalescence temperature are a largely dehydrated surfactant phase and a phase which is largely water.) The presence of a specific phase coalescence temperature in aqueous solution is another characteristic of nonionic surfactants which is a key to the practice of the present invention.

By "strong electrolyte" is meant a compound which completely ionizes in aqueous solution at moderate concentrations (such as a concentration of 700 ppm to 20,000 ppm).

By "sequestering builder" is meant a detergent additive which sequesters water hardness to assist a surfactant in performing its intended function. Sequestering builders are electrolytes, but typically are not strong electrolytes as defined herein.

By "adjuvant" is meant a detergent ingredient which provides a function, such as brightening, bleaching, or the like, other than the functions performed by surface active agents and sequestering builders.

THEORY OF THE INVENTION

While no limit on the scope of the invention is intended by setting forth the theory of its operation which follows, it is believed that the following theory of operation explains the present invention and distinguishes it from the prior art.

Molecules of a surface active agent, in particular nonionic surfactants, consist of a lipophilic portion, commonly referred to as a "tail," and a hydrophilic portion, commonly known as a "head." The head, being hydrophilic, prefers an orientation of the surfactant molecule which allows it to be in contact with the water of an aqueous solution. The tail of the surfactant molecule, being lipophilic, prefers an orientation of the surfactant molecule which allows it to be in contact with oily species or tails of other surfactant molecules. The contrasting properties of the head and tail portions of the surfactant molecule, particularly in the case of nonionic surfactants useful in the present invention, dictate the orientation of the surfactant in aqueous solution. The orientation of surfactant molecules in an aqueous system is not constant, but varies in relation to solution temperature, surfactant identity and concentration, the presence of other species in solution, and so forth.

At a temperature below its cloud point temperature and at a concentration below its critical micelle concentration, surfactant molecules in aqueous solution exist in the form of monomers. In effect, the individual molecules are largely independent of each other, and each surfactant molecule is surrounded by water molecules.

If the concentration of surfactant in the foregoing solution of monomers is allowed to exceed the critical micelle concentration (CMC) of the surfactant, individual molecules of surfactant begin to orient themselves into micelles, which are structures wherein several surfactant molecules arrange themselves with their oleophilic tails together and their hydrophilic heads presented outeard, so that water molecules are isolated from the surfactant tails by an exterior surface of surfactant heads. At surfactant concentrations exceeding the CMC, the concentration of monomers remains more or less equal to the critical micelle concentration, so that the surfactant species present in excess of the CMC exist as micelles.

If the temperature of the surfactant solution is now increased to exceed the cloud point temperature of the aqueous solution (or if agents are added to the solution to lower its cloud point temperature to below the solution temperature, as further explained hereinafter), the micelles will each become sufficiently large that the solution will scatter light, rendering it cloudy in appearance.

If the solution temperature is further raised (or its cloud point temperature is further lowered) so that the solution is somewhat warmer than its cloud point temperature, the surfactant species begin to dehydrate. This means that the surfactant species progressively lose their solution-like attraction to water molecules.

Ultimately, if the temperature of the solution is raised to its phase coalescence temperature (or if the solution's phase coalescence temperature is lowered below its actual temperature by adding agents similar to those added to lower the cloud point temperature), the surfactant species will dehydrate to such an extent that much of the surfactant will separate as a second, surfactant rich, bulk phase.

Now consider the effects of these potential conditions of a surfactant solution on its ability to function as a washing liquor, particularly in the context of laundering oily soils from fabrics in a washing machine. In this context, cleaning must be both thorough and rapid if a product is to be effective.

Figure 5:
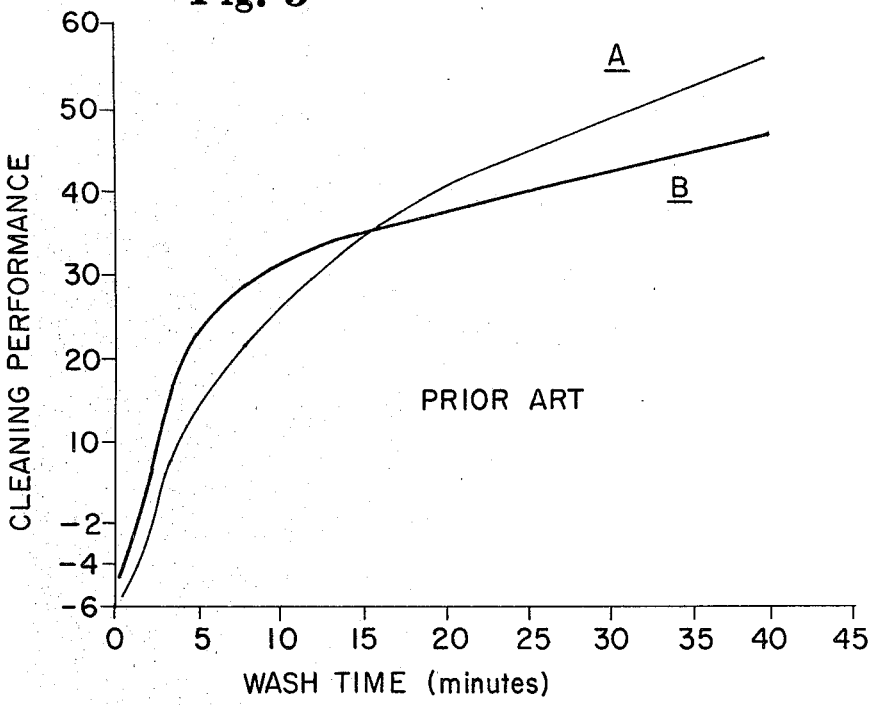
FIG. 5 is a graph of cleaning performance versus time under prior art washing conditions for a surfactant having a high critical micelle concentration (B) versus a surfactant having a low critical micelle concentration (A).

Solutions containing a large proportion of monomeric surfactant species have long been selected by workers in the art for use in washing because they act much faster (under prior art conditions) than highly micellized solutions. This is graphically illustrated in FIG. 5, in which plot A illustrates the performance of a surfactant with a CMC of 5 ppm (Neodol 45-7, which is described more fully below), and in which plot B illustrates the performance of a surfactant with a CMC of 200 ppm (Neodol 91-6, as further defined below). The concentration of each surfactant is equal, each surfactant has an HLB of about 11.5, and in each case the surfactant concentration is many times greater than the surfactant CMC. The test is conducted below the cloud point temperature of each washing liquor. Under these conditions each solution has a monomer concentration which is roughly the same as its CMC. As will be noted from FIG. 5, the high CMC surfactant, with its high concentration of monomers, outperforms the low CMC surfactant for more than 15 minutes, which is a typical maximum length for the washing cycle of a commercial laundering machine. Thus, the need for efficient laundering has led the prior art to the choice of high CMC surfactants.

It is known in the art that a low CMC surfactant should exhibit better ultimate cleaning than a high CMC surfactant because the former surfactants are superior to the latter ones for reducing the interfacial tension between oil and water in a two-phase system. This means that low CMC surfactants should more efficiently solubilize or emulsify fatty soils. And as FIG. 5 suggests, a low CMC surfactant does clean to a better end result, even under prior art conditions, if given enough time. Thus, what has been needed is a way to improve the rate of cleaning of low CMC surfactants while retaining their thoroughness of cleaning.

The inventors have found that by using low CMC surfactants in a washing liquor maintained at a temperature substantially exceeding its cloud point temperature, so that the surfactant species coexist in a single bulk phase with water but are largely dehydrated, the rate of cleaning of low CMC surfactants is sufficiently increased that they clean better than high CMC surfactants. This surprising result is explained as follows.

Under prior art conditions the micelles which predominate in solutions of low CMC surfactants migrate to sites of oily soil very slowly and/or do not quickly reorient themselves from their water-stable form, in which their hydrophilic heads are presented outward, to a form in which their lipophilic tails are able to contact droplets of oily soils and solubilize or emulsify them. Under these prior art conditions a high CMC surfactant can clean more quickly because its high concentration of monomers travels quickly through solution to sites of oily soil. These monomers also do not need to reorient themselves into a less stable state to attach themselves to soils, for their lipophilic tails are constantly exposed.

However, when washing is conducted at a temperature substantially in excess of the cloud point temperature (or, conversely, if the cloud point temperature of the solution is made lower than the washing temperature selected), the disadvantages of micelles as cleaning species are largely eliminated. This effect is believed to result because at a temperature somewhat above the cloud point temperature the surfactant species have just enough affinity for water to remain in a single bulk phase, and this largely dehydrated surfactant species has little difficulty in solubilizing or emulsifying oily soils since the surfactant molecules apparently are more randomly oriented. Moreover, this surfactant species is believed to be transported by bulk transport to the sites of oily soils more rapidly than ordinary micelles, in contrast to prior art conditions which allow only monomeric species to participate in rapid cleaning, thus limiting the concentration of species available for cleaning to CMC, which is low for the preferred (low CMC) surfactants.

The inventors have also ascertained an upper limit to washing temperatures which may be used if the benefits of the present invention are to be obtained. It has been found that the present invention should be practiced at a washing temperature which does not exceed the phase coalescence temperature of the washing liquor. (Or, to put it another way, the phase coalescence temperature must not be lowered to below the washing temperature selected.) This upper limit is probably observed because, while the surfactant will be delivered and mixed with oily soils more rapidly, it will not be removed at all because it is dehydrated and too hydrophobic to be a good solubilizing or emulsifying agent under these conditions. Methods not forming a part of the present invention must be employed to effectively clean fabrics with the two-phase surfactant/water system which exists when the washing temperature exceeds the phase coalescence temperature of the surfactant system in a washing liquor.

SELECTION OF WASHING CONDITIONS

In practicing the present invention washing is conducted at a temperature within a range given by the following expression:

$$0.30\,(B-A)+A \leqq T < B$$

wherein A is the cloud point temperature of the washing liquor, B is the phase coalescence temperature of the washing liquor and T is the washing temperature. Preferred and especially preferred temperature ranges for practice of the present method are given by the following expressions, respectively:

$$0.50\,(B-A)+A \leqq T < B;$$

$$0.70\,(B-A)+A \leqq T < B.$$

The following hypothetical example will illustrate the use of the above expressions to select washing temperatures for washing liquors having particular cloud point and phase coalescence temperatures. Consider a washing liquor of the present invention with a cloud point temperature (A) of 40° C. and a phase coalescence temperature (B) of 80° C. (These values would be determined for an actual washing liquor according to the procedure taught below, using a photo gonio diffusometer.) The broadest range of washing temperatures is calculated thus:

$$0.30\,(B-A)+A \leqq T < B$$

$$[0.30\,(80°-40°)]+40° \leqq T < 80°$$

$$12°+40° \leqq T < 80°$$

$$52° \leqq T < 80°$$

The same numbers may be substituted into the expression for preferred washing temperatures as follows:

$$0.50\,(B-A)+A \leqq T < B$$

$$[0.50\,(80°-40°)]+40° \leqq T < 80°$$

$$20°+40° \leqq T < 80°$$

$$60° \leqq T < 80°$$

In like fashion, the especially preferred temperature for use of the indicated washing liquor is calculated as follows:

$$0.70\,(B-A)+A \leqq T < B$$

$$[0.70\,(80°-40°)]+40° \leqq T < 80°$$

$$28°+40° \leqq T < 80°$$

$$68° \leqq T < 80°$$

Using the above calculations for the hypothetica washing liquor, the broad, preferred, and especially preferred washing temperatures for this washing liquor are found to be 52° C. to just less than 80° C., 60° C. to just less than 80° C., and 68° C. to just less than 80° C.

Figure 2:
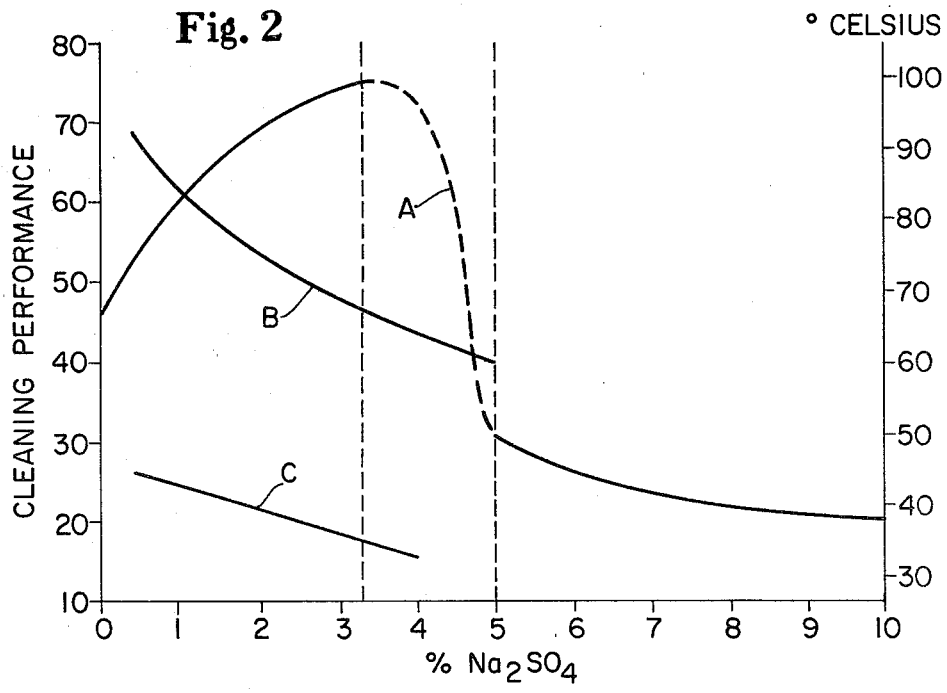
FIG. 2 is a graph showing the cloud point temperature (C) and phase coalescence temperature (B) of a 3000 ppm solution of the condensate of a primary fatty alcohol having 14 to 15 carbon atoms with an average of about 7 ethylene oxide moieties per molecule of surfactant as a function of electrolyte (sodium sulfate) concentration. Superimposed is a plot (A) of cleaning performance at 60° C. of the solution as a function of electrolyte concentration.

FIGS. 1 and 2 illustrate the importance of choosing a washing liquor with certain cloud point and phase coalescence temperatures in relation to the washing temperature in order to produce an optimum cleaning result.

FIG. 1 is a plot of cleaning performance (Hunter whiteness) versus temperature for a washing liquor with a cloud point of 36° C. and a phase coalescence temperature of 71° C. As the graph illustrates, cleaning performance continues to increase as the wash temperature is increased above the cloud point until the general area of the phase coalescence temperature is reached. Beyond this point, higher temperatures produce poorer performance.

In FIG. 2, plot A shows the washing performance at 60° Celsius (measured as Hunter whiteness of fabrics washed by a standard method) of Neodol 45-7 (a surfactant comprising a primary fatty alcohol containing 14 to 15 carbon atoms condensed with an average of 7 ethylene oxide moieties per molecule of surfactant commercially available from Shell Chemical Co., Industrial Chemicals Division) as a function of concentration of sodium sulfate—an electrolyte which has no substantial function except to lower the phase coalescence and cloud point temperatures of the system. The area between the dotted lines represents an unstable area because the phase coalescence temperature is near the washing temperature. Accurate experimental data in this area is impossible to obtain. On the same graph are plotted the cloud point and phase coalescence temperatures of the washing liquor (C and B, respectively) versus percentage sodium sulfate in the washing liquor, thus defining a series of systems which have the same surfactant and washing temperature but differing phase coalescence and cloud point temperatures. The cleaning test was run at a single temperature in order to eliminate the difference in cleaning which would be expected due to the choice or differing washing temperatures. FIG. 2 is an example of altering the cloud point and phase coalescence temperature of a washing system by electrolyte addition. The maximum performance of the system occurs when the phase coalescence temperature is maintained slightly above the wash temperature (60° C.).

PREFERRED WASHING LIQUORS

The washing liquors of the present invention are aqueous dispersions of a nonionic surfactant. The surfactant may be present in concentrations of from about 1800 ppm to about 20,000 ppm. If it is desirable to raise the cloud point and phase coalescence temperatures of the washing liquor in accordance with the teachings of the present invention, the washing liquor may include up to about 10% of an anionic surfactant. Alternatively, one or more nonionic surfactants having a high cloud point temperature may be added to the washing liquor to raise the net cloud point and phase coalescence temperatures of the system. If it is desirable to lower the cloud point and phase coalescence temperatures of the washing liquor in accordance with the teachings of the present invention, 700 to 10,000 ppm of a strong electrolyte may be added to the washing liquor. The cloud point and phase coalescence temperatures of the washing liquor may alternatively be lowered by adding a surfactant with a low cloud point temperature to the washing liquor to lower the net cloud point and phase coalescence temperatures of the system. It is also highly desirable to add 500 to 10,000 ppm of a sequestering builder to washing liquors of the present invention in order to improve their cleaning ability. Finally, many detergency adjuvants and other optional ingredients may be added to compositions within the scope of the present invention. In the text which follows, the selection of each of these ingredients is described in greater detail.

SURFACTANT

The single essential ingredient of an aqueous washing liquor which may be used to practice the present invention is a surfactant (or mixture of surfactants) which has certain properties. The desired concentration of the surfactant in the washing liquor is from about 1800 ppm to about 20,000 ppm. It will be noted that this concentration is at least 36 times the critical micelle concentration of the surfactant, which should be less than 50 ppm. Thus, it will be apparent that the present invention teaches a very high concentration of surfactant compared to its critical micelle concentration, in contrast to the prior art teaching that washing with surfactant concentrations substantially in excess of the critical micelle concentration of the system does not improve surfactant performance because the concentration of the surfactant in excess of its CMC is tied up in the form of micelles.

The first consideration in choosing a surfactant or mixture of surfactants for use in the present invention is that the primary surfactant should be a nonionic surfactant. Not only are nonionic surfactants the main category of surfactants which have HLB's within the range which is useful in the present invention, but in addition only a surfactant system consisting entirely or mostly of nonionic surfactants will exhibit a cloud point temperature and a phase coalescence temperature. Since the existence of these particular phase attributes of the washing liquor is essential to the definition of the present invention, it is important that the surfactant system primarily comprise nonionic surfactants.

Figure 4:
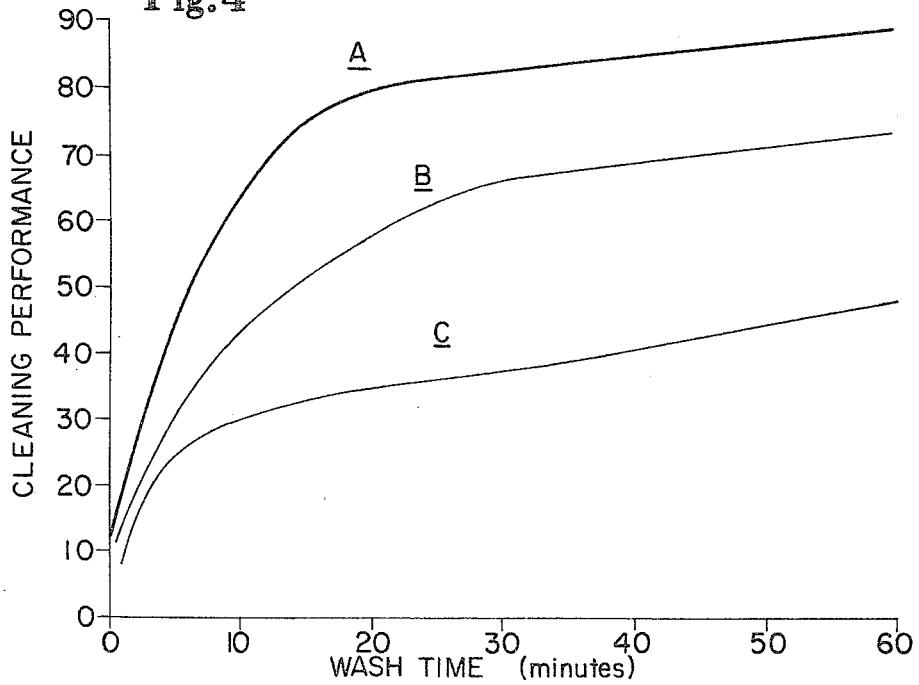
FIG. 4 is a graph of soil removal versus wash time for three nonionic surfactants (A, B, and C) with different hydrophilic/lipophilic balance indices but similar characteristics in other respects.

The second consideration in choosing a surfactant is its HLB. The choice of a surfactant with an optimized HLB is demonstrated in the plots of FIG. 4, in which three washing systems are compared which differ only in the choice of a surfactant HLB. In this test, three nonionic surfactants were chosen, each of which is a condensate of a fatty alcohol and a chain of ethylene oxide moieties. The surfactant chosen for the HLB 8.2 plot (plot C) was an ethoxylation product of a primary fatty alcohol having 12 to 13 carbon atoms with an average of 3 ethylene oxide moieties per molecule of surfactant. The HLB 15.0 plot (plot B) depicts the performance of a nonionic surfactant comprising a condensate of primary fatty alcohols having 14 to 15 carbon atoms with an average of 15 ethylene oxide moieties per molecule of surfactant. The HLB 11.6 plot (plot A) depicts the performance of a nonionic surfactant comprising 14 to 15 carbon primary alcohols with an average of 7 ethylene oxide moieties per molecule of surfactant. The critical micelle concentrations of the nonionic surfactants were 10 ppm, 5 ppm, and 12 ppm, respectively. The performance of each of these surfactants was optimized for the washing temperature used (60° Celsius) by the addition of electrolytes as will be described hereinafter. As shown in FIG. 4, which plots cleaning performance (measured as Hunter whiteness of fabrics washed with the respective solutions, which is determined as shown in Example 1 below) versus time in minutes, the surfactant with an HLB of 11.6 demonstrated better cleaning performance for all tested washing times than did the surfactant with an HLB of about 15 or the surfactant with an HLB of about 8.2. This illustrates that optimum cleaning performance is obtained using a surfactant system with an HLB between 10 and 13. It will be noted that individual surfactants which have HLB's outside this range may be combined to form a surfactant system which has an HLB within the indicated range without departing from the present invention. Hereinafter the phrase "total surfactant hydrophilic/lipophilic balance index" is used to denote the net HLB of all surfactants in a system.

The third consideration in choosing a surfactant or mixture of surfactants for use in the present invention is that the surfactant should have a CMC which is below about 50 ppm. As is explained above, selection of a surfactant with a CMC which is much less than its in-use concentration, using the particular washing temperatures of the present invention, improves the cleaning action of the surfactant. Example 2 below also demonstrates that a low CMC surfactant displays superior cleaning when used in accordance with the teachings of the present invention.

When a mixture of surfactants is selected as the surfactant component of a washing liquor which is to be used to practice the present invention, cloud point temperature and phase coalescence temperature values specified herein refer to properties of the washing liquor. The HLB and CMC of the sufactant system are essentially independent of the other components in the wash liquor. Consequently, HLB values for specific surfactants can be determined by methods known to those skilled in the art and CMC values can be measured in distilled water. The values of these parameters for a mixture of surfactants are determined as follows.

The HLB of a mixture of surfactants is determined using the following formula:

$$HLB_{mixture} = aHLB_A + bHLB_B + \ldots + nHLB_N$$

wherein the parameters are the HLB's of the respective surfactants and the coefficients indicate the fraction of total surfactant weight contributed by each surfactant.

The CMC of a mixture of surfactants is determined using the following equation:

$$CMC_{mixture} = \left( \frac{a}{CMC_A} + \frac{b}{CMC_B} + \ldots + \frac{n}{CMC_N} \right)^{-1}$$

wherein the numerators are the mole fractions of the respective components (compared to total moles of surfactants) and the denominators are the CMC's of the respective surfactants.

There is no simple relationship between the cloud point and phase coalescence temperatures of individual surfactants and of mixtures of surfactants. However, addition of a high cloud point surfactant to a surfactant solution with a lower cloud point will raise the cloud point to the solution, while addition of a low cloud point surfactant to a similar solution will lower its cloud point. An analogous relation also holds true when the phase coalescence temperature of the system is to be adjusted. Thus, it will be a simple matter for a person skilled in the art to formulate a mixture of surfactants with the desired cloud point and phase coalescence temperatures.

In the event that an anionic surfactant is to be included in the nonionic surfactant system to raise its cloud point and phase coalescence temperatures, an additional problem in formulation is raised because anionic detergents do not typically have a cloud point or phase coalescence temperature in aqueous solutions. This is the case because the temperature at which such a surfactant dispersion would exhibit these properties is greater than the boiling point of the aqueous dispersion at atmospheric pressure. A person skilled in the art of formulating detergents can resolve this difficulty by obtaining cloud point and phase coalescence temperatures of aqueous surfactant solutions which are subjected to a pressure exceeding their vapor pressure. This will then aid the formulator's initial estimate of the amount of the anionic surfactant which must be added in order to obtain the desired adjustment in the phase properties of the system.

Following is a detailed description of specific nonionic surfactants which may be used to formulate surfactant systems when practicing the present invention.

A first category of nonionic surfactants which are useful in the practice of the present invention are most broadly defined as ethoxylated aliphatic alcohols. These surfactants are the condensation products of a fatty alcohol with an ethoxylate chain comprising at least one ethoxylate moiety per molecule of surfactant, especially between about 1 and about 12 moles of ethoxylate moieties per molecule of surfactant for purposes of the present invention. Commercially available ethoxylated fatty alcohols generally contain between about 8 and about 22 carbon atoms in their alcohol moiety, preferably 12 to 15 carbon atoms for the purpose of the present invention. Typical surfactants of this type have a broad distribution of degrees of ethoxylation, since species having various ethoxylate chain lengths are difficult to separate, or even to identify, in the commercially available materials. Preferred ethoxylated alcohol surfactants for use in the present invention have an average of 5 to 8 moieties of ethylene oxide per molecule of surfactant, preferably an average of 7 moieties. When a degree of ethoxylation is specified hereinafter, it will be understood that this refers to the average number of ethoxylate moieties per molecule of surfactant.

One commercial source of alcohol ethoxylates useful in the practice of the present invention is the Neodol series of surfactants, which are available from Shell Chemical Company, Industrial Chemicals Division. The Neodol surfactants are characterized by a low degree of branching in the alcohol chain; typically less than about 20% of the surfactant molecules are branched. Neodols are primary alcohol ethoxylates which each have a narrow and precisely indicated range of alcohol chain lengths, but a large variation in the degree of ethoxylation in a given molecule; the average number of ethoxylate groups per molecule is provided for the surfactants. An example of how Neodols are named is Neodol 45-7, which is a condensate of a 14 to 15 carbon fatty alcohol with an average of 7 ethylene oxide moieties per molecule of surfactant. Another example is Neodol 91-6, which comprises the condensate of a 9 to 11 carbon fatty alcohol with an average of 6 ethylene oxide moieties per molecule of surfactant.

Specific examples of Neodol surfactants which are useful in practicing the present invention are as follows: Neodol 45-7, 45-15, 23-6.5, or 25-7; a mixture of 75% Neodol 25-5 and 25% Neodol 45-7; a mixture of 50% Neodol 25-7 and 50% Neodol 45-7; a mixture of 50% Neodol 91-6 and 50% Neodol 45-7; and so forth. (Some of these surfactants are useful only in conjunction with other ingredients. Formulation of such mixtures is explained elsewhere in this specification.)

Another commercial source of ethoxylated fatty alcohols is the Tergitol series of surfactants which are commercially available from Union Carbide Corporation. Tergitols are alcohol ethoxylates, and may be divided into S Tergitols and L Tergitols. The former are relatively unbranched secondary alcohols, while the latter are primary alcohols having a high numerical percentage of branched species. (About 40% of the alcohol moieties of L Tergitols are branched, while a lower percentage of the alcohol moieties of S Tergitols are branched.) In commercially supplied Tergitols, the range of ethoxylation for a given surfactant is somewhat narrower than is observed in the Neodols. The Tergitols are named in a manner analogous to the naming of Neodols, except that the name contains an upper case "S" or "L" interposed between the numerals indicating alcohol chain length and the numeral indicating degree of ethoxylation. Specific examples of Tergitol surfactants which are useful in the practice of the present invention are Tergitols 15-S-3, 15-S-5, 15-S-7, 15-S-9, 25-L-3, 25-L-5, 25-L-7, or 25-L-9. (Again, some of these surfactants must be combined with other ingredients as disclosed herein in order to be useful in the practice of the present invention.)

A second major category of nonionic surfactants which are useful in the practice of the present invention is that of the alkyl phenol ethoxylates. The structure of these surfactants is that of benzene with two substituents in para relationship. The first substituent is an alkyl moiety with a chain length of 7 to 12 carbon atoms, preferably 8 to 9 carbon atoms for purposes of the present invention. The second substituent is an ethoxylation chain. The alkyl phenol ethoxylates have an ethylene oxide substitution level which varies widely for a given surfactant. The degree of ethoxylation in such surfactants is essentially from 1 to 12 ethylene oxide moieties per molecule of surfactant; an average of 7 ethylene oxide moieties per molecule of surfactant is preferred for use in this invention.

Specific alkyl phenol ethoxylates which are useful in the practice of the present invention are the Igepal surfactants manufactured by General Aniline and Film Corporation. The Igepal surfactants are designated by two upper case letters followed by a numeral or series of numerals; the lettered prefix "CA" indicates an octyl radical as the alkyl moiety of the surfactant, while the lettered prefix "CO" indicates a nonyl radical as the alkyl moiety. The inventors are not aware of any connection between the numerals designating species of this class of surfactants and the structures thereof. A specific example of Igepal surfactant useful in the practice of the present invention is Igepal CO-610.

A third broad class of nonionic surfactants which are useful in the practice of the present invention are the condensation products of a chain of ethylene oxide moieties with a hydrophobic base formed by the condensation of a chain of propylene oxide moieties with propylene glycol, known hereinafter as ethylene oxide/propylene oxide block copolymers.

One commercially available series of ethylene oxide/propylene oxide block copolymers is the PLURONIC (trademark) Series marketed by BASF Wyandotte Corporation. The Pluronics are named using a letter prefix (L for a liquid, P for a paste, and F for a flaked or solid composition) and a two to three digit suffix, the first digit or two defining a molecular weight range and the final digit defining the percent of ethylene oxide in the surfactant, divided by 10. The molecular weight corresponding to the first digits in the surfactant name is indicated in Table I which follows:

TABLE I

| First Digit(s) | Molecular Weight Range |
|---|---|
| 3 | 950 |
| 4 | 1200 |
| 5 | 1450 |
| 6 | 1750 |
| 7 | 2050 |
| 8 | 2250 |
| 9 | 2750 |
| 10 | 3250 |
| 11 | 3625 |
| 12 | 4000 |

A specific example of a Pluronic surfactant which is useful in the present invention is Pluronic L-43, which is a liquid composition with a hydrophobic portion molecular weight of 1200 and 30% by composition weight of ethylene oxide.

While certain nonionic surfactants have been indicated as preferred, the invention may be practiced using any of a broad selection of nonionic surfactants, several additional examples of which follow. One additional example of such a surfactant is a polyoxyethylene ester of a fatty acid, such as Stearox CD, which is marketed by the Monsanto Company. Another example is the Triton series of nonionic alkyl phenol surfactants, marketed by Rohm and Haas Company. Other nonionics which are useful in the present invention are the polyoxyethylene mercaptan analogs of the alcohol ethoxylates, such as Nonic 218 and Stearox SK which are manufactured by the Monsanto Company. Other examples of nonionic surfactants are polyoxyethylene adducts of alkyl amines, such as the Ethoduomeen and Ethomeen surfactants marketed by Armak Company. Polyoxyethylene alkyl amides may also be used in the practice of this invention. Another category of nonionic surfactants is the sorbitan esters, such as sorbitan monolaurate. Finally, the Surfonic surfactants manufactured by Jefferson Chemical Company, Inc., such as Surfonic N-95, which is an alcohol phenol ethoxylate, may be used in the practice of the present invention. This list of nonionic surfactants is not exhaustive, and it is contemplated that routine experimentation will result in the location of other surfactants which may be used to practice the present method invention.

Table II below contains HLB, CMC, cloud point, and phase coalescence temperature data for a variety of aqueous solutions of pure commercial surfactants. With the aid of this table, a person skilled in the art may formulate a wide variety of washing liquors which are useful for laundering fabrics. (In the table which follows, $TAE_{11}$ is a primary fatty alcohol ethoxylate surfactant having a predominance of alcohol chain lengths of about 14 to 18 carbon atoms and an average of 11 ethoxylate moieties per molecule of surfactant; $TAE_9$ is a similar surfactant, but is substituted with an average of 9 ethoxylate moieties per molecule of surfactant; STP is sodium tripolyphosphate; LAS is a linear alkylate sulfonate surfactant comprising benzene substituted by a sulfonate group and a $C_{12}$ alkylate group in para orientation; and $Na_2CO_3$ is sodium carbonate.)

TABLE II

SURFACTANT PHYSICAL PROPERTY DATA

| Surfactant | CMC (ppm) | HLB | Cloud Point Temp. °C. | Phase Coalescence Temp. °C. |
|---|---|---|---|---|
| Pluronic L63 | 25 | 11 | 47 | 68 |
| Pluronic L64 | 40 | 15 | 60 | 85 |
| Pluronic P103 | 6 | 9 | 91 | Above 100 |
| Pluronic P104 | 12 | 13 | Above 100 | Above 100 |
| Pluronic P105 | 10 | 15 | 96 | Above 100 |
| Igepal CO610 | 32 | 12.2 | 33 | 84 |
| Igepal CO630 | 74 | 13 | 61 | Above 100 |
| Igepal CA420 | 398 | 8 | Insoluble | Insoluble |
| Igepal CA630 | 178 | 13 | 65 | Above 100 |
| Igepal CA720 | 158 | 14.6 | 87 | Above 100 |
| Surfonic N-95 | 36 | 13 | 54 | Above 100 |
| Surfonic N-60 | 10 | 10.9 | Insoluble | Insoluble |
| Surfonic N-120 | 35 | 14.1 | 84 | Above 100 |
| Neodol 45-7/25L3 | 28 | — | — | — |
| $TAE_{11}$ | 158 | 12.8 | — | — |
| Neodol 23-3 | 10 | 8.0 | 43 | Over 100 |
| Neodol 45-15 | 12 | | — | — |
| Mixture: 25% Neodol 45-7 75% Tergitol 25L5 | 14 | 11 | — | — |
| Mixture: 50% Neodol 45-7 50% Tergitol 25L7 | 18 | — | — | — |
| Tergitol 15S3 | 8 | 8.0 | Below 0 | 28 |
| Tergitol 15S5 | 10 | 10.5 | Below 0 | 38 |
| Tergitol 15S7 | 45 | 12.1 | 38 | 80 |
| Tergitol 15S9 | 56 | 13.3 | 55 | Over 100 |
| Tergitol 25L3 | 20 | 7.7 | Below 0 | 25 |
| Tergitol 25L5 | 4 | 10.4 | Below 0 | 65 |
| Tergitol 25L7 | 18 | 12.4 | 52 | 88 |
| Tergitol 25L9 | 18 | 12.8 | 62 | Over 100 |
| $TAE_9$ | 71 | 12.0 | 59 | Over 100 |
| Neodol 45-7 | 5 | 11.6 | 47 | 88 |
| Neodol 91-6 | 200 | 12.5 | 52 | Over 100 |
| Neodol 23-6.5 | 16 | 12.0 | 45 | 86 |
| $C_{12}$ LAS | 211 | 20 | — | — |
| Tergitol 15S7 with 1000 ppm STP | 32 | 12.1 | 35 | 72 |
| Mixture: 50% Neodol 91-6 50% Neodol 45-7 | 17 | 12.0 | 46 | 82 |

The cloud point temperatures and phase coalescence temperatures of Table II were measured visually or on a photo gonio diffusometer made by SOFICA (Model 42.000) at a surfactant concentration of 3000 ppm in laboratory distilled water. The index vat of the above apparatus contained Dow Corning 702 Silicone fluid and the temperature range of the instrument was 30° C. to 100° C. The photo detection unit of the instrument was positioned at an angle of 90° with respect to the incoming light beam. Samples of each surfactant were prepared at a concentration of 3,000 ppm using laboratory distilled water. No other special treatment was used to reduce interfering impurity particles which can be visually seen in some nonionic surfactant solutions. A green instrument filter and no polarizing filter were used, and the instrument's variable slit was adjusted for appropriate base intensity starting light scattering measurements. To obtain the cloud point and phase coalescence temperatures, the samples were heated at the rate of approximately ½° Celsius per minute using a variable voltage transformer. The cloud point temperature was determined as the initial temperature at which the light scatter reading deviated from the base light scatter, indicating a sharp increase in light scattering due to the formation of nuclei of sufficient size to scatter light. The phase coalescence temperature was interpreted to be the temperature at which the light scattering returned to the base line scatter after having increased to the maximum. This represents a temperature at which the solution separates into two bulk phases, each of which is much less cloudy than the mixture before separation of aqueous and surfactant phases. The use of a photo gonio diffusometer to measure the "cloud point temperature" of a surfactant solution or system is desirable where significant baseline light scattering interfering particles are present. The "cloud point temperature" is that temperature at which a sharp increase in the solution cloudiness occurs as it is slowly heated above 30° C. The CMC's of Table II were determined in distilled water at 25° C.

Cloud Point/Phase Coalescence Temperature Adjustment

Given that the optimum washing conditions for a given surfactant are confined to a narrow temperature range, it is highly desirable to enable the practitioner to vary the cloud point and phase coalescence temperatures of a given surfactant system in order to formulate a composition containing a desired nonionic surfactant to be used at a selected washing temperature. This is highly desirable because certain washing temperatures are highly preferred in the art for washing certain types of fabrics and for removing particular soils.

In the event that a nonionic surfactant has relatively low cloud point and phase coalescence temperatures, so that the temperature for washing in accordance with the teaching of this invention is lower than the desired washing temperature for given fabric and soil conditions, small amounts of an anionic detergent may be incorporated into a surfactant system which contains a major amount of the nonionic surfactant in order to substantially raise the cloud point and phase coalescence temperatures of the system. It will be noted, however, that the percentage of total surfactant content supplied by an anionic surfactant should not exceed about 10% of the surfactant system to avoid creating a surfactant system which does not have a cloud point or phase coalescence temperature.

One typical anionic surfactant which may be used to raise the cloud point and phase coalescence temperatures of the washing liquors is a linear alkylate sulfonate (LAS), which is benzene substituted with an alkylate moiety and a sulfonate moiety in para relation. An especially preferred LAS has a dodecanate group as its alkylate moiety and is typically referred to in the art as $C_{12}$ LAS. Another type of anionic surfactant which may be used for this purpose is an alkylate ethoxylate sulfate (AES) comprising an alkyl moiety, to which is attached an ethoxylate chain, to which in turn is attached a sulfate moiety. One typical AES surfactant has a dodecyl group as its alkyl moiety and a six-unit ethoxylate chain. A third type of anionic surfactant which may be used to raise the cloud point and phase coalescence temperatures of a nonionic surfactant system is a tallow alkyl sulfate (TAS) surfactant. This surfactant contains alkyl moieties having a range of carbon chain lengths, predominantly alkyl moieties having from about 14 to about 18 carbon atoms.

For the nonionic surfactants described above which have been found to be most useful for washing, it is typically necessary to lower the phase coalescence temperature and cloud point temperature of the surfactant system in order to produce a composition which is useful for washing at temperatures which are preferred in the art. This is especially true given the recent tendency in the art to prefer lower washing temperatures in order to save energy in the laundering process. A highly preferred way to lower the optimum washing temperature of a washing liquor to a preferred value is to add to the surfactant system any of a wide varity of strong electrolytes.

It will be appreciated by those skilled in the art of formulating nonionic surfactant compositions that the addition of nearly any strong electrolyte to a system containing a nonionic surfactant will lower the cloud point of the surfactant system, as well as the phase coalescence temperature. Just a very few examples of appropriate electrolytes are the water-soluble chemical compounds of an anion selected from chloride, bromide, silicate, orthosilicate, metasilicate, orthophosphate, sulfate, carbonate, nitrate, fluoride, acetate, hydroxide, citrate, and others, and a cation selected from sodium potassium, lithium, calcium, magnesium and hydrogen. This list is by no means exhaustive, and those skilled in the art will easily select any of a wide variety of strong electrolytes, depending on the availability of particular salts and other factors. Preferred electrolytes are those which supply alkalinity to the washing medium, although a high degree of alkalinity is not necessary to the practice of the present invention. Of the electrolytes noted above, the sodium salts are highly preferred as strong electrolytes because they are highly soluble and inexpensive, and of those sodium salts sodium carbonate is the most preferred strong electrolyte in the practice of the present invention. Typically the amount of a strong electrolyte which must be added to the washing liquor to optimize the cloud point and micelle inversion temperatures will lie between about 700 ppm and 20,000 ppm.

Figure 3:
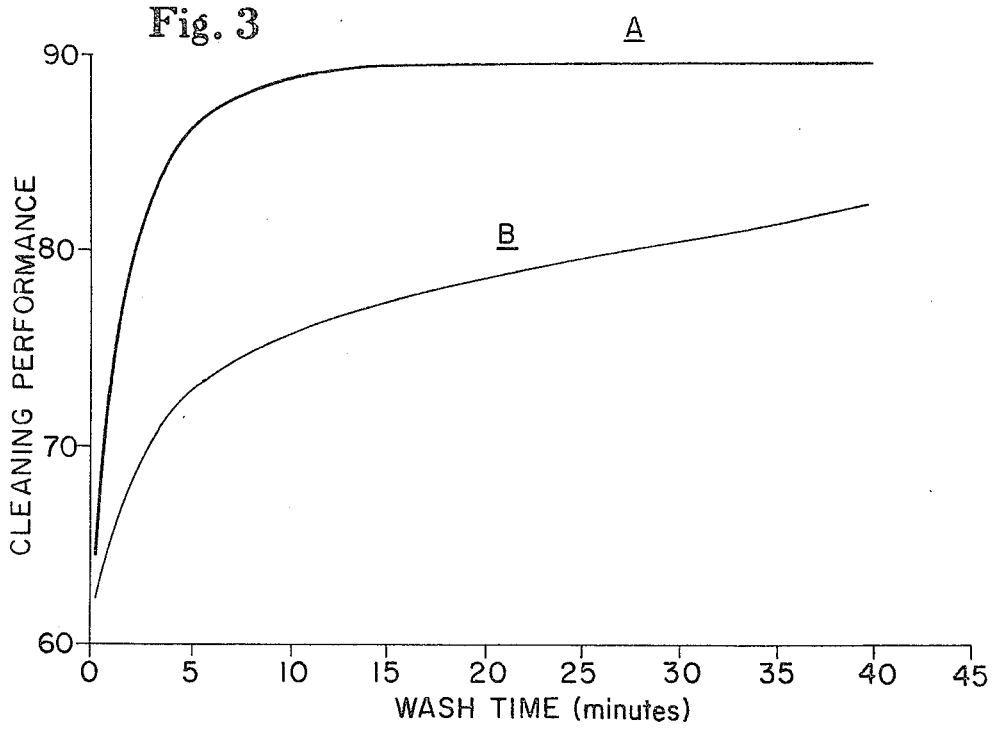
FIG. 3 is a graph of cleaning performance versus time for a washing liquor (A) which contains a strong electrolyte, as opposed to a washing liquor (B) which does not.

FIG. 3 is a plot of cleaning performance (Hunter whiteness) versus wash time for two washing liquors. Plot "A" is for a washing liquor containing Neodol 45-7 and a strong electrolyte (sodium sulfate) to optimize its performance at the washing temperature used. Plot B is for the same washing liquor and washing temperature, but excluding the electrolyte. As indicated in FIG. 3, for any of the wash times tested the washing liquor containing an electrolyte produces superior washing results. This result is obtained because the washing liquor which did not contain a strong electrolyte had cloud point and phase coalescence temperatures which placed the washing composition and conditions outside the scope of the present invention, while the washing liquor containing a strong electrolyte had lowered phase coalescence and cloud point temperatures which placed the identical washing composition and conditions within the scope of the present invention.

Sequestering Builders

While washing liquors containing a nonionic surfactant and having particular cloud point and phase coalescence temperatures are useful in themselves for laundering fabrics, their effect can be improved by adding thereto about 500 ppm to 10,000 ppm of a sequestering builder.

A wide variety of sequestering detergency builders is known in the art. A number of these are conveniently described as compounds of a cation selected from sodium, potassium, lithium, or hydrogen, and an anion selected from tripolyphosphate, pyrophosphate, orthophosphate, nitrilotriacetate, ethylene diamine tetraacetate, nitrilotrimethylphosphonate, and ethylene diamine tetramethylphosphonate. It will also be noted that some ingredients which act as strong electrolytes may also be useful as sequestering detergency builders, for example, orthophosphates. However, the best sequestering builders are only modestly electrolytic at the concentration typically used in a detergent. Especially preferred sequestering builder salts for incorporation in washing liquors of the present invention are any of the polyphosphate builders known to the art, particularly alkali metal tripolyphosphates and pyrophosphates such as sodium tripolyphosphate or tetrasodium pyrophosphate.

These sequestering builders are widely recognized in the art as important additives for laundry detergents.

These builders have traditionally been thought to be primarily useful to prevent water hardness cations from interacting with soaps or anionic detergents to form an insoluble precipitate or soap scum. However, such sequestering builders are also known to provide cleaning benefits to washing liquors containing only nonionic surfactants, which do not interact with water hardness ions. The sequestering builders prevent water hardness ions such as calcium and magnesium from interacting with fatty soils to form insoluble precipitates. The sequestering builders also sequester other metal ions such as copper and iron ions which can interfere with the action of the bleaching agents which are frequently used in conjunction with laundry detergents. Several of the sequestering builders also peptize clay soils by replacing various cations in the insoluble clays with sodium cations or the like, rendering the clays somewhat soluble in the washing liquor. Finally, these builders have utility as soil suspending agents. While certain of the sequestering builders have also been used in the prior art in order to provide a more alkaline washing liquor, this particular function of sequestering builders is not particularly important to the present invention because the washing liquors disclosed herein function well at a surprisingly low pH—typically such washing liquors may have a pH of about 7 to 11 and still display the benefits of the present invention.

Commercial Detergent Compositions

Commercially useful detergent compositions for laundering fabrics are typically sold as concentrated formulas which are diluted in water by the user in order to produce the desired aqueous washing liquor. What follows is a specific description of washing compositions which may be diluted in water to form washing liquors within the definition of the present method invention.

The following ingredients may be combined in the indicated proportions to produce compositions which may be diluted in water to produce washing compositions useful to practice the present invention:

(a) about 10% to about 78% of a nonionic surfactant;
(b) about 4% to about 45% of an electrolyte; and
(c) about 3% to about 45% of a detergency builder salt.

Such compositions may be dissolved in water to form a solution which contains from about 1000 to 40,000 ppm (0.10% to 4.0%) of the composition.

The following compositions contain preferred proportions of specific ingredients. They may be diluted in the proportions noted above to form washing liquors:

(a) 20% to 51% of an alkali metal tripolyphosphate;
(b) 24% to 40% of an alkali metal carbonate; and
(c) 20% to 51% of the condensate of a fatty alcohol having 12 to 15 carbon atoms with an average of about 5 to about 8 ethoxylate moieties per molecule of surfactant; or;
(a) 20% to 40% of an alkali metal pyrophosphate;
(b) 25% to 40% of an alkali metal carbonate; and
(c) 20% to 55% of the condensate of a fatty alcohol having 12 to 15 carbon atoms with an average of about 5 to about 8 ethoxylate moieties per molecule of surfactant.

Finally, the following compositions are specifically formulated for optimal washing in the concentration specified above at a temperature of about 140° F. (60° Celsius):

(a) about 36% sodium tripolyphosphate;
(b) about 35% sodium carbonate; and
(c) about 29% of the condensate of a primary fatty alcohol having 14 to 15 carbon atoms with an average of about 7 ethylene oxide moieties per molecule (Neodol 45-7); or
(a) about 31% tetrasodium pyrophosphate;
(b) about 34.6% sodium carbonate; and
(c) about 34.4% of the condensate of a primary fatty alcohol having 14 to 15 carbon atoms with an average of about 7 ethylene oxide moieties per molecule of surfactant (Neodol 45-7).

In addition to the cleaning benefits of formulations which may be used to practice the present invention, they may be used to wash effectively at a relatively low pH. Typical washing liquors used in industrial laundries arts are highly alkaline, having a pH exceeding about 11.5. Such pH's are essential in conventional industrial laundry detergents in order to saponify oily soils and thus increase their solubility in the washing liquor. In order to provide such a high pH in the washing liquor typical industrial laundry detergents contain large quantities of alkaline or caustic substances. These substances are frequently hazardous to the user and damaging to fabrics which are repeatedly washed in them. Some prior art laundry detergents which contain caustic materials may also be expensive to store and transport because special precautions must be taken to prevent them from harming persons or property. Thus, the high pH of prior art industrial laundering compositions has many disadvantages.

The compositions of the present invention are desirably formulated to have a pH of 11 or less, particularly from about 7 to about 11. This is possible because the cleaning ability of the compositions disclosed herein has been found to be relatively insensitive to pH. While a high pH cleaning composition may easily be formulated in accordance with the present invention (for exampe, a composition which provides a washing liquor pH greater than 11.5), no substantial cleaning benefit is found to result from the selection of a high pH. The compositions of the present invention are able to solubilize or emulsify oil quite effectively without relying on saponification.

The compositions may be assembled in any of the ways known to the art to form commercial preparations which are suitable for sale.

EXAMPLES

The following examples do not limit the scope of the present invention, which is defined by the claims concluding this specification. Rather, these examples illustrate the practice of the invention under controlled conditions. In these examples "$Na_2CO_3$" is sodium carbonate, "$Na_2SO_4$" is sodium sulfate, "STP" is sodium tripolyphosphate, "TSPP" is tetrasodium pyrophosphate, the Neodol surfactants are certain primary fatty alcohol ethoxylates, as characterized above, and "$TAE_9$" is a primary fatty alcohol ethoxylate having a predominance of alcohol chain lengths in the range of from 14 to 18 carbon atoms and an average of 9 ethoxylate moieties per molecule of surfactant. Where dextrin is present it functions as a binder and does not substantially affect the performance of compositions containing it.

EXAMPLE 1

Removal of Oily Soil by Surfactants of Differing HLB

A series of 65% polyester/35% cotton swatches with a permanent press finish were soiled with used motor oil obtained from automobile crankcases. These swatches were washed for 20 minutes in a Tergotometer, Model 7243, at 60° C. in soft water with the compositions listed below. Octadecane at a level of 300 ppm was added to the wash solution to simulate extra soil in the system. The temperature of each washing liquor was within the range of the present invention. The washed swatches were rinsed for 10 seconds in cold water and dried, and Hunter whiteness measurements were made using a Hunter Laboratories Color/Difference Meter (Model D25D2). (This instrument provides a direct readout of Hunter whiteness).

| Composition A | Composition B |
|---|---|
| 1000 ppm STP | 1000 ppm STP |
| 1000 ppm $Na_2CO_3$* | 8000 ppm $Na_2CO_3$* |
| 3000 ppm Neodol 47-7 | 3000 ppm Neodol 45-15 |
| Surfactant HLB: | |
| 11.6 | 15.0 |
| Hunter Whiteness: | |
| 80.0 | 53.8 |
| Composition C | |
| 1000 ppm STP | |
| 200 ppm $Na_2CO_3$* | |
| 3000 ppm Neodol 23-3 | |
| Surfactant HLB: | |
| 8.2 | |
| Hunter Whiteness: | |
| 34.2 | |

*The $Na_2CO_3$ level was optimized to give maximum performance for each system.

The HLB ranges of Compositions B and C were outside the temperature range required for the present invention, while Composition A had an HLB range within the invention and demonstrated superior performance.

EXAMPLE 2

Removal of Oily Soil by Surfactants of Differing CMC

A series of stains were cut from discarded, naturally soiled industrial uniforms. These stains were split into equally soiled parts; each part was washed with one of the compositions listed below. The stains were washed in a 35 lb. Milnor washer/extractor with 18.5 lbs. of industrial uniform shirts soiled with 1.5 lb. of used motor oil. A wash temperature of 60° C. was used. After washing, the stained parts were placed back together and graded visually in a paired comparison manner by a panel of 3 judges using a 0–4 scale. A grade of "0" indicated no difference between the paired swatches; a grade of "1" indicated a perceived difference between the swatches; a grade of "2" indicated a clear difference between the swatches; a grade of "3" indicated a large difference between the swatches; and a grade of "4" indicated a very large difference between the swatches. These grades were statistically combined to produce Paired Comparison Grades, which represent the difference in cleaning performance for a given composition (positive for an improvement) with respect to the inferior composition.

| Composition A | Composition B |
|---|---|
| 2960 ppm Neodol 45-7 | 2960 ppm $TAE_9$ |
| 3680 ppm STP | 3680 ppm STP |
| 3560 ppm $Na_2CO_3$ | 3560 ppm $Na_2CO_3$ |
| Surfactant CMC: | |
| 5 ppm | 71 ppm |
| Paired Comparison Grade: | |
| +1.35 units | 0 |

The CMC of Composition B was outside the range required by the present invention. The process used with Composition A was within the scope of the present invention and demonstrated superior performance.

EXAMPLE 3

Removal of Oily Soil Under Differing Phase Conditions

The procedure described in Example 1 was used.

| Composition A | Composition B |
|---|---|
| 20,000 ppm $Na_2SO_4$ | 50,000 ppm $Na_2SO_4$ |
| 3,000 ppm Neodol 45-7 | 3,000 ppm Neodol 45-7 |
| Cloud Point: | |
| 43° C. | 32° C. |
| Phase Coalescence Temp.: | |
| 85° C. | 58° C. |
| Hunter Whiteness: | |
| 69.3 | 44.8 |

The process using Composition B was outside the claims of this invention, for the wash temperature (60° C.) exceeded the phase coalescence temperature of the washing liquor. The process used with Composition A is within the claims and produces superior performance.

EXAMPLE 4

Removal of Oily Soil by a Prior Art Process vs. the Claimed Process

The procedure described in Example 2 was used.

| Composition A | Composition B |
|---|---|
| 2580 ppm $Na_2CO_3$ | 10,000 ppm Pierce II* |
| 2120 ppm TSPP | 1,130 ppm Maximum* |
| 2310 ppm Neodol 45-7 | |
| 170 ppm Dextrin | |
| 7180 ppm Total | 11,130 ppm Total |
| pH: 10.7 | 12.3 |
| Cloud Point: 42° C. | 85° C. |
| Phase Coalescence Temp. 80° C. | — |

-continued

| Composition A | Composition B |
|---|---|
| Paired Comparison Grade: +3.4 units | 0 |

*Pierce II is a commercial laundry detergent manufactured by The Procter & Gamble Co. Maximum is a commercial detergency booster manufactured by The Procter & Gamble Co. The two products are typically combined as in Composition B to clean industrial uniforms.

The process using Composition B is outside the claims of this invention because the wash temperature used was below the cloud point temperature of Composition B. The process used with Composition A was within the claims of this invention and produced superior performance, even though Composition A was substantially more dilute and had a much lower pH than Composition B.

EXAMPLE 5

Removal of Oily Soil by Products of Varying Composition

The procedure of Example 2 was used. The compositions were added to the wash water to produce washing liquors having the indicated concentrations.

| Composition A | Composition B |
|---|---|
| 27.7% $Na_2CO$ | 40.7% $Na_2CO$ |
| 34.3% TSPP | 28.1% TSPP |
| 38.0% Neodol 45-7 | 31.2% Neodol 45-7 |
| Product Conc.* | |
| 6800 ppm | 8300 ppm |
| Paired Comparison Grade: | |
| +1.43 units | 0 |

*The only component which varies in solution concentration is $Na_2CO_3$.

Composition B is outside the more preferred composition range claimed in this invention due to its high $Na_2CO_3$level. Composition A is near the center of the range and produces superior performance. The 60° C. wash temperature was within the temperature range of the present invention for each composition.

EXAMPLE 6

Removal of Oily Soil by Products of Varying Composition

The procedure described in Example 5 was used.

| Composition A | Composition B |
|---|---|
| 27.7% $Na_2CO_3$ | 16.9% $Na_2CO_3$ |
| 34.3% TSPP | 39.4% TSPP |
| 38.0% Neodol 45-7 | 43.7% Neodol 45-7 |
| Product Concentration* | |
| 6800 ppm | 5900 ppm |
| Paired Comparison Grade: | |
| +1.24 | 0 |

*The only component which varies in solution concentration is $Na_2CO_3$.

Composition B is outside the more preferred composition range claimed in this invention due to its low $Na_2CO_3$ level. Composition A is near the center of the range and produces superior performance. Again, the 60° C. washing temperature for each composition was within the temperature range of the present invention.

What is claimed is:

1. A process for laundering oily soil from a fabric, comprising the step of contacting said fabric with an aqueous washing liquor, having a total surfactant hydrophilic/lipophilic balance index of about 10–13, comprising:

(a) 1800 ppm to 20,000 ppm of a nonionic surfactant system which has a critical micelle concentration of less than 50 ppm measured at 25 degrees Celsius in distilled water;

(b) 500 ppm to 10,000 ppm of a sequestering builder selected from compounds of a group of cations selected from sodium, potassium, lithium and hydrogen ions and a group of anions selected from tripolyphosphate, pyrophosphate, orthophosphate, nitrilotriacetate, ethylene diamine tetraacetate, nitrilotrimethyl phosphate, and ethylene diamine tetramethylphosphonate ions, and mixtures thereof; and (c) 700 ppm to 20,000 ppm of a strong electrolyte; while maintaining said washing liquor at a temperature within the range given by the expression $$0.30(B-A)+A \leqq T < B$$

wherein T is the temperature of said washing liquor, B is the phase coalescence temperature of said washing liquor and A is the cloud point temperature of said washing liquor.

2. The process of claim 1 wherein said washing liquor is maintained within a temperature range given by the expression:

$$0.50(B-A)+A \leqq T < B.$$

3. The process of claim 2 wherein said washing liquor is maintained within a temperature range given by the expression:

$$0.70(B-A)+A \leqq T < B.$$

4. The process of claim 1 wherein said nonionic surfactant is selected from a group comprising alkyl phenol ethoxylates, ethylene oxide/propylene oxide block copolymers and aliphatic ethoxylated alcohols.

5. The process of claim 4 wherein said nonionic surfactant is a condensate of a fatty primary alcohol having 12 to 15 carbon atoms and 5 to 3 ethoxylate moieties per molecule of surfactant.

6. The process of claim 1 wherein said nonionic surfactant system has a critical micelle concentration of less than 25 ppm.

7. The process of claim 6 wherein said nonionic surfactant system has a critical micelle concentration of less than 10 ppm.

8. The process of claim 1 wherein said washing liquor has a total surfactant hydrophilic/lipophilic balance index of about 11.5.

9. The process of claim 1 wherein said strong electrolyte is an alkali metal carbonate.

10. The process of claim 1 wherein said sequestering builder is tetrasodium pyrophosphate.

11. The process of claim 1 wherein said sequestering builder is sodium tripolyphosphate.

12. The process of claim 1 wherein said washing liquor is maintained at a pH of about 7 to 11.

* * * * *

UNITED STATES PATENT AND TRADEMARK OFFICE

CERTIFICATE OF CORRECTION

PATENT NO. : 4,332,692

DATED : June 1, 1982

INVENTOR(S) : N.S. Payne, T.D. Storm and T.C. Stephens

It is certified that error appears in the above-identified patent and that said Letters Patent are hereby corrected as shown below:

Col. 8, line 7, "hypothetica" should be -- hypothetical --.

Col. 11, line 4, "to" should be -- of --.

Col. 14, in Table II, the Cloud Point Temp. °C. of surfactant Tergitol 15S7, shown as "38" should be -- 35 --.

Col. 16, line 16, "varity" should be -- variety --.

Col. 18, line 22, "concentration" should be -- concentrations --.

Col. 8, line 49, "or" should be -- of --.

Col. 12, line 67, after "of" and before "Igepal" insert -- an --.

Signed and Sealed this

*Seventh* Day of *June 1983*

[SEAL]

*Attest:*

DONALD J. QUIGG

*Attesting Officer*

*Acting Commissioner of Patents and Trademarks*